United States Patent [19]

Parks

[11] Patent Number: 5,052,857

[45] Date of Patent: Oct. 1, 1991

[54] PLACEMENT OF FORAMINOUS PIPING IN NON-COHESIVE SUBSOILS

[76] Inventor: James M. Parks, 3509 Merric Ct., #210, Lexington, Ky. 40502

[21] Appl. No.: 465,838

[22] Filed: Jan. 16, 1990

[51] Int. Cl.[5] ..... E02B 3/02

[52] U.S. Cl. ..... 405/73; 405/21; 405/52; 405/74

[58] Field of Search ..... 405/73, 74, 21, 52, 405/43, 45, 50, 36, 15; 37/61-63

[56] References Cited

U.S. PATENT DOCUMENTS

| | | | |
|---|---|---|---|
| 593,430 | 11/1897 | O'Meara | 405/74 |
| 3,479,830 | 11/1969 | Ostarly | 405/172 |
| 4,074,535 | 2/1978 | Schoonmaker | 405/74 |
| 4,252,466 | 2/1981 | Berti et al. | 405/172 |
| 4,480,942 | 11/1984 | Farrow | 405/303 X |
| 4,524,501 | 3/1986 | Sloan | 405/74 X |
| 4,898,495 | 2/1990 | Lin | 405/15 X |

FOREIGN PATENT DOCUMENTS

| | | | |
|---|---|---|---|
| 0618601 | 8/1978 | U.S.S.R. | 405/172 |

*Primary Examiner*—Dennis L. Taylor

*Attorney, Agent, or Firm*—Charles A. McClure

[57] ABSTRACT

Placement of foraminous dual piping in non-cohesive subsoil, and use in beach stabilization or use in fluidization as navigation channel maintenance. Air, water, or mixed fluid medium is jetted from the foraminous piping downward onto and into such subsoil so as to fluidize it, while the piping is pressed downward, as by earth anchors, into the fluidized subsoil until it is below the level of adjacent subsoil located apart from the fluidization vicinity. A zigzag arrangement of flanking earth anchors as viewed from above and interconnected by tie bars from earth anchor to adjacent earth anchor in the pattern.

18 Claims, 4 Drawing Sheets

PLACEMENT OF FORAMINOUS PIPING IN NON-COHESIVE SUBSOILS

TECHNICAL FIELD

This invention relates to placement of foraminous piping in non-cohesive subsoils, as for fluidization or stabilization thereof, concerning improved ways and means for burying such piping therein.

BACKGROUND OF THE INVENTION

Numerous methods have been suggested and many have been used in an effort to control erosion, and to encourage accretion, of sand and other non-cohesive soils, especially in the instance of beaches—and to discourage deposition of (or to displace) undesired sand or soil, especially in channels useful for shipping. Attempts to overcome undesired effects of wave action have usually been unavailing in the long run, sometimes producing the opposite of what was sought and/or other deleterious results. Man has to learn to use nature rather than to fight it in such environmental efforts.

Informative articles about beach stabilization include "New Method for Beach Erosion Control" by Machemehl, French, and Huang in *Civil Engineering in the Oceans/III* (1975) 142–160 and "Experimental Control of Beach Face Dynamics by Water-Table Pumping" by Chappell, Eliot, Bradshaw, and Lonsdale in *Engineering Geology,* 14 (1979) 21–40—both of which describe how water withdrawal from subjacent beach sand is conducive to deposition of more sand. Vesterby U.S. Pat. No. 4,645,377 teaches such dewatering just below the mean high water level. A somewhat similar test project has been under way at Sailfish Point near Stuart, Fla. since the late summer of 1988, with very promising results. All such methods utilize buried piping.

Channel maintenance (or creation) traditionally is accomplished by dredging, repeated whenever wave action or other currents tend to fill in the channel, which is frequently. Dredging costs enough the first time, and necessary repetition is an aggravation of expense. Fluidization as an alternative to dredging is also well recognized, as by Bruun in "Maintaining Tidal Inlet Channels by Fluidization" *J. Waterway, etc. Engineering,* ASCE, 110 (ww4) 117–120; Bruun and Adams in "Stability of Tidal Inlets: Use of Hydraulic Pressure for Channel and Bypassing Stability" *J. Coastal Research* 4 (1988) 687–701; and by the present inventor with others, especially Weisman and Collins, as in "Fluidization as Applied to Sediment Transport (FAST) as an Alternative to Maintenance Dredging of Navigation Channels in Tidal Inlets" *Wastes in the Ocean vol II:* Dredged Material Disposal in the Ocean, Kester et al. (eds.) Wiley (1983).

However, even such alternative channel clearing and maintenance have relied upon the energy-intensive step of dredging to enable the necessary piping to be buried preparatory to fluidizing use.

The pipe placement art is represented by van Steveninck U.S. Pat. No. 3,695,049, in which piping to be buried is supplied with one or more small accompanying pipes to fluidize underlying subsoil "causing the pipeline together with the fluidization pipes to sink into the fluidized seabed"—on the one hand and, on the other hand—"Pipeline Burial by Fluidization" Paper No. OTC 2276 of OFFSHORE TECHNOLOGY CONFERENCE of the American Institute of Mining, Metallurgical, and Petroleum Engineers at Dallas, Tex. in 1975, wherein a horseshoe-shaped device overlies and straddles piping to be emplaced and fluidizes the adjacent non-cohesive bottom with water jetted from openings in hollow lower stringers of such device, and the piping sags under its weight and the extra weight of the straddling device and sinks into the adjacent fluidized bottom of the subjacent, preferably sandy soil. Clay may interfere with such a goal.

My present invention provides improved means and methods for burying such piping, and for retaining buried piping in place, as for use in non-cohesive soil fluidization for channel maintenance, or in such subsoil stabilization for beach extension or maintenance.

SUMMARY OF THE INVENTION

A primary object of this invention is to provide a method of placing foraminous pipe for fluidization and/or stabilization usage.

Another object is to provide foraminous pipe assemblies with associated installation means and methods.

A further object is to provide means and methods of removing from the subsoil into which piping is to be buried such potentially interfering objects as may be in the way of lowering the piping.

In general, the objects of the invention are accomplished by positioning foraminous piping along a desired route on non-cohesive subsoil, jetting a fluid medium from the foraminous piping downward to fluidize the subsoil, and pressing the piping downward thereinto. More particularly, the method includes pushing and/or pulling the piping downward into fluidized subsoil until it is emplaced therein.

Apparatus for practicing the foregoing method and accomplishing the foregoing objects comprises foraminous piping, a fluid medium jettable from the piping, means for pushing and/or pulling the pipe down into the subsoil, and optionally means for removing fluidized soil and/or objects embedded therein from the vicinity of the lowering piping, and/or means for securing the piping when in place.

Other objects of this invention, together with means and methods for attaining the various objects, will be apparent from the following description and the accompanying diagrams of diverse embodiments, all presented by way of example rather than limitation.

SUMMARY OF THE DRAWINGS

In these diagrammatic views, scale is variable so as to permit appropriate emphasis of components or features. Corresponding items are identified in successive views by like reference symbols, often augmented by "round number" increments for successive embodiments.

DESCRIPTION OF THE INVENTION

Figure 1:
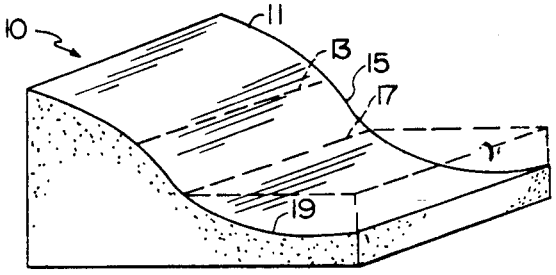
FIG. 1 is perspective view of a section of waterfront land and water suitable for treatment according to this invention.

FIG. 1 shows, in perspective, section 10 of waterfront property having several successive portions ranging from high and dry land portion 11 at the far left, sometimes dry and sometimes wet or intertidal beach portion 15 just to the right thereof, and lower seafloor portion 19 at the near right—by way of an ocean, sea, lake, river, estuary, delta, or the like. Boundaries (broken lines) between adjacent portions are marked along mean high water (MHW) line 13 between the dry land and the intermittently dry/wet beach, and along mean low water (MLW) line 17 between beach and sea, etc.

Figure 2:
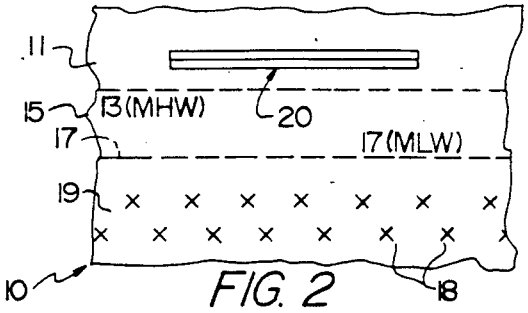
FIG. 2 is an overhead or plan view corresponding to FIG. 1, with piping to be installed laid out on the dry land and with sites for anchoring it indicated offshore where covered by the water.

FIG. 2 shows, from overhead, a preliminary layout for apparatus of this invention. On dry land just above the MHW line is a string of dual piping assembly 20 (close parallel lines). Near the bottom of the view and below the MLW line is a zigzag or double line 18 (crosses) of sites for earth anchoring means for the piping.

Figure 3:
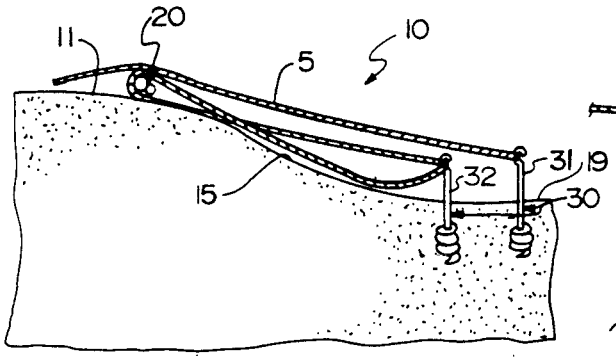
FIGS. 3 and 4 are side sectional elevations of such location at preliminary stages in positioning piping of this invention.

FIG. 3 shows from the side (with limited sectional shading) same section 10 of waterfront with auger-like earth anchors 30, each having a rope-receiving, preferably open, loop at its top end, preliminarily placed in the planned double row. Thus, earth anchor in the seaward (or right-hand) row has rope 5 tied thereto; the rope extends up to and over the dual-pipe assembly (20) and then underneath it and back through the top end loop of earth anchor 32 in the landward (or left-hand)row; finally, the free end of the rope is left available onshore, preferably above the piping. It will become apparent that pulling to the left on the end of rope 5 would pull the piping assembly down into the water and against the landward row of anchors, whereupon one of the rows preferably is removed.

Figure 4:
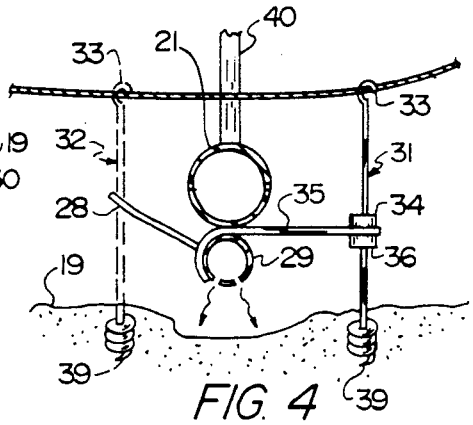

FIG. 4 shows a close-up of piping assembly 20, sectioned transversely and located between the lines of earth anchors, represented by seaward anchor 31 shown in solid lines and landward anchor 32 now shown in broken lines to indicate removal thereof—as with the rope, after detachment thereof from the remaining, previously tied anchor. Piping assembly 20 is seen to comprise upper or working pipe 21 and lower or installation pipe 29 suitably secured together by suitable means (not shown). Earth anchors 31 and 32 have open loop 33 at the top end and auger-like lower end 39. Affixed to the intermediate portion of anchor 31 approximately midway of its ends and retained by upper and lower nuts 34 and 36 flanking it is retaining bracket 35, which extends horizontally and fastens to the pipe assembly, as by passing partway around the installation pipe. The auger ends of the anchors are shown screwed into the subsoil. Flow of fluid (arrows) out from the lower part of the latter pipe is indicated as having indented the top surface of the underlying subsoil 19 a bit. Fluid supply hose 28 is shown leading to installation pipe 29, and vertical riser 40 leading from working pipe 21, both well behind the plane of this view.

Figure 5:
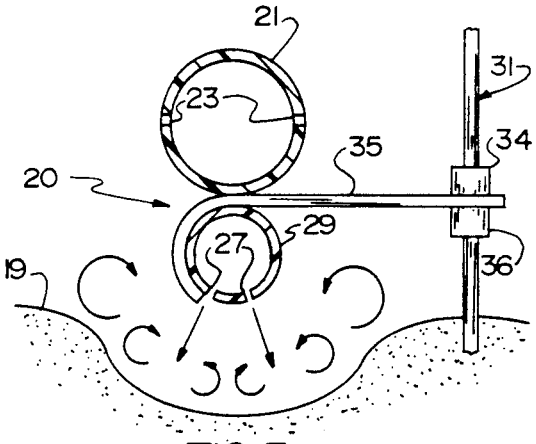
FIG. 5 is a schematized side sectional elevation of the same piping, so positioned, at an early stage in fluidization to bury it.

FIG. 5 shows piping assembly 20 free of the positioning rope and beginning to be buried in place. Lateral openings 23 are shown at opposite sides of working pipe 21, whereas the lowermost part of installation pipe 29 has openings 27 through which fluid (indicated by straight arrows) is exiting the pipe and is producing vortices (arcuate arrows) in the water between the pipe and underlying non-cohesive subsoil of seabed 19. The vortices entrain subsoil particles (mostly sand) and fluidize it enough to enable the piping to be pulled downward by gravity and manual or mechanical screwing of the earth anchor(s)—see FIG. 4—downward at the same time or from time to time. Suspended particles settle wherever movement of the water under the influence of the fluid from the installation pipe and/or other currents may happen to carry them.

Figure 6:
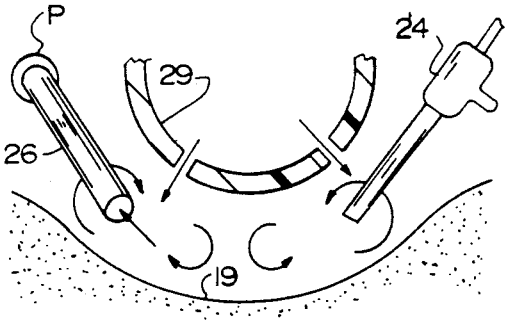
FIG. 6 is a schematized side sectional elevation in the vicinity of the bottom end of the piping, during such installation.

FIG. 6 shows the lower part of installation pipe 29 with its openings 27 much as in FIG. 5 but with the open end of slurry hose 26 inserted at the left into the turbulent space between the pipe and the underlying non-cohesive subsoil (mostly sand). Slurry pump P shown at the other end of the hose may be locally or remotely situated. Also shown, intruding from the right into the space between the installation pipe and the subsoil is accessory fluid injector or vibrator 24 to cope with any obstacles in such space, as by stirring them to be withdrawn by the exhaust hose or dislodging them for removal from the space, whether thereby or otherwise.

Figure 7:
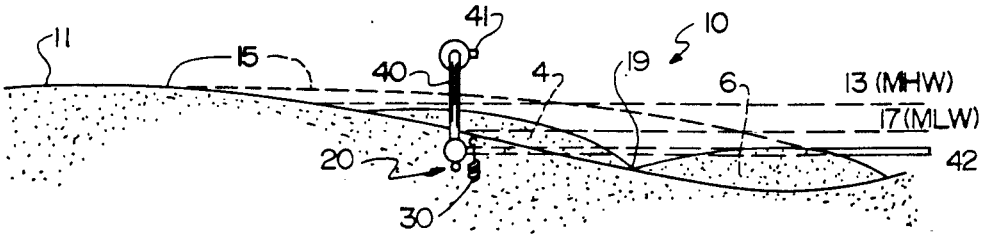
FIG. 7 is a schematic elevational view similar to the nearer edge of FIG. 1, showing the contours of the land before and after beach stabilization with the apparatus just described.

FIG. 7 shows, in a schematic elevational view, location 10″—i.e., location 10 after stabilization of original location 10. Riser 40 is upright from connection with working pipe 21 of piping assembly 20. Water is drained by pump 41 shown at the top of the riser and is discharged at an appropriate distance therefrom. Also shown connected to the working pipe is generally horizontal cleanout line 42 extending seaward; it will be understood that such line enables sand accumulated in the pipe to be flushed out to sea rather than to be picked up by the discharge pipe—in the interest of extending the working life of drainage pumps intolerant of sand. Alternatively, an electric submersible pump may be located at the base of riser 40, with its discharge into seaward line 42 through a check valve to prevent seawater from entering working pipe 21 therefrom.

Contours of the land before and after beach stabilization with the equipment just described also appear in this view. The original rapid fall-off of beach (solid line) has been replaced by a higher and more slowly descending land surface (broken line). A "lazy 8" pattern of shading with its left lobe 4 covering the piping assembly and its right lobe 6 just below the original seafloor, represents optional startup transfer of seafloor subsoil to cover the piping assembly to a greater depth than accomplished by fluidized emplacement, as through displacement through scraping of the right lobe subsoil landward to occupy the left lobe.

The substantial beach accretion may suggest removal of the stabilization piping and seaward relocation of it, preferably somewhat earlier than the time of this view. A simple but effective and inexpensive procedure for doing so is described subsequently herein. Of course, where the earth anchors are buried completely, as here, a buoy attached to the hooked top end would tend to remain in view. Alternatively, the metal earth anchors can be detected magnetically.

In fluidization use, the piping tends to remain visible—or at least visually locatable by an obvious depression in the seafloor. Indeed, a principal fluidization use is to create and maintain a channel along the piping, such as for navigational purposes. A concurrent or separate fluidization use is to enable sand or other fluidized subsoil undesired at its existing location to be transported to a more desirable place. Examples of both uses follow.

Reference numerals in the fluidization embodiments for features or components similar to those in the prior stabilization embodiment are one (or more) hundred larger for convenience in cross-reference and to save undue repetition. Non-analogous items have dissimilar numbers in the respective series.

Figure 8:
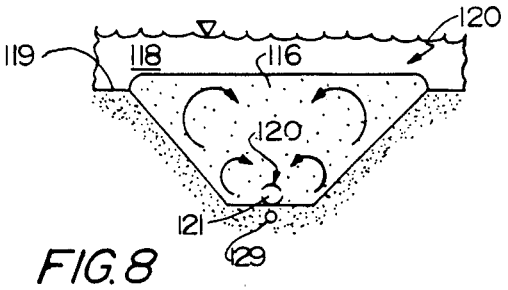
FIG. 8 is a schematic transverse elevational section of the same piping, similarly emplaced, but as used for fluidization.
Figure 9:
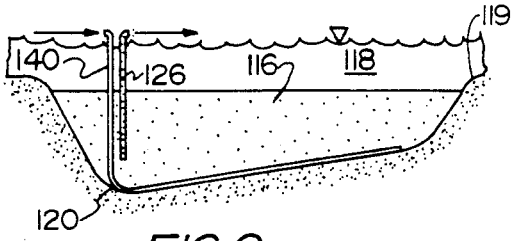
FIG. 9 is a schematic longitudinal elevation of such fluidization corresponding to FIG. 8 and including slurry transport piping.

FIGS. 8 and 9 show location 1;? (quite stylized) with seafloor base into which piping assembly 120 has been sunk well below preexisting seafloor 119, forming V-shaped channel 116 (FIG. 8). Stippling indicates the water having fluidized subsoil (sand) content. Water 118 above the level of the surrounding seafloor carries little or no sand and is shown clear. In the longitudinal view of FIG. 9 the channel bed slopes downward from its remote end to its end nearer riser 140. Exhaust line 126 also dips in the deep end of the channel to aid sand removal so as to maintain the channel at appropriate depth and width (based upon the angle of repose of sand).

Figure 10:
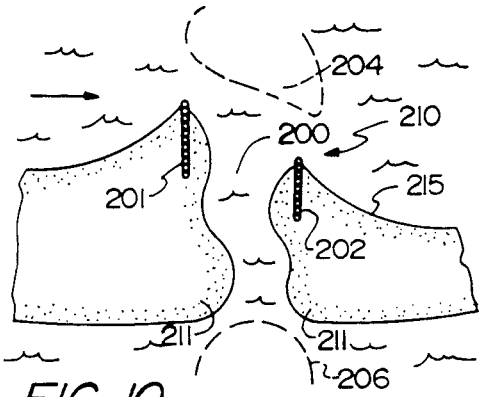
FIG. 10 is an overhead plan view of a navigational inlet before operation of apparatus of this invention therein.

FIG. 10 shows, from overhead, navigational inlet location 210 in poor condition. A large open arrow indicates the drift of water past serpentine inlet 200, defined in part at its seaward end by updrift jetty 201 and downdrift jetty 202. Located near that end of the inlet is seaward shoal 204 (broken line) and similarly near the landward end of the inlet is shoal 206, the two shoals effectively blocking the inlet except for very small boats or rafts.

Figure 11:
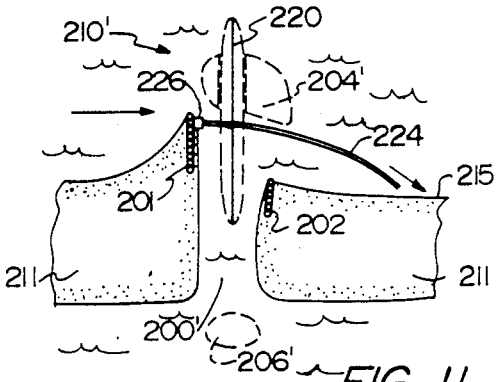
FIG. 11 is a similar plan view of the same navigational inlet location after operation of apparatus of this invention therein.

FIG. 11 shows location 210' (otherwise like location 210) after installation of fluidization according to this invention. Centerfed fluidization piping assembly 220 extends both seaward and landward near the seaward end of the updrift jetty. Relatively straight inlet 200' has replaced serpentine inlet 200. The landward end portion of piping assembly 220 is central to the straightened inlet, and landward shoal 206' is greatly diminished in size. The seaward end of the piping assembly splits shoal 204' into two unequal parts. Exhaust riser 226 is affixed to updrift jetty 201 and has lateral discharge line 224 terminating (end arrow) onto downdrift beach 215.

Details of fluid supply to the piping assemblies in the preceding and following views are omitted to focus upon features that are more likely to be unfamiliar to ordinarily skilled persons.

Figure 12:
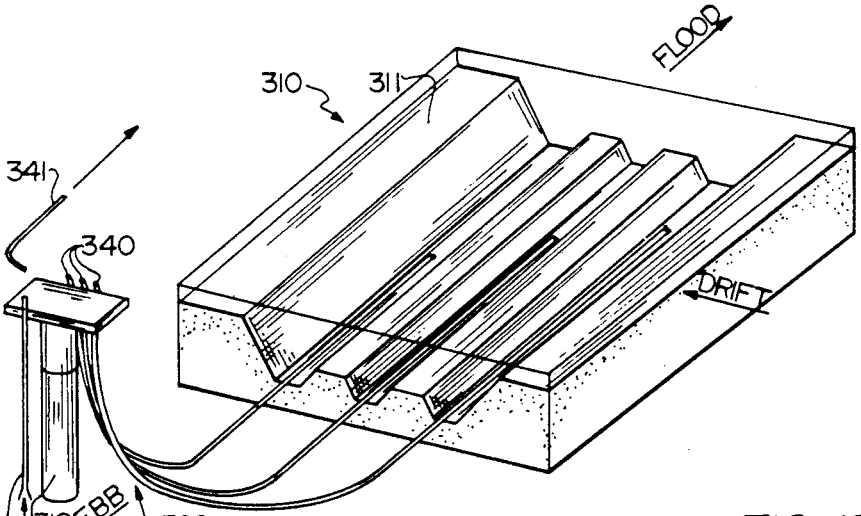
FIG. 12 is a schematic perspective view of a multiple piping fluidization arrangement useful in maintaining an inlet channel.

FIG. 12 shows in stylized form wide-channel three-branch piping assembly 320 of this invention, without any attempt (because of the scale) to show its dual pipes on each branch. Upstanding platform 312 supports exhaust riser 326, as well as fluidizing risers 320.

Figure 13:
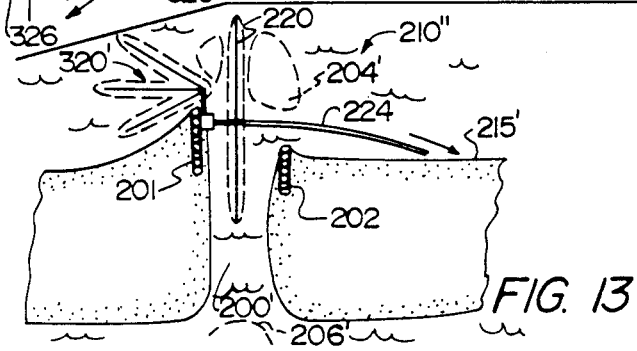
FIG. 13 is a plan view of a multiple piping system bypassing sand from updrift to downdrift locations past an inlet channel.

FIG. 13 shows modified three-branch embodiment 320' installed at the previous inlet location (here designated 210''). The fluidizer of FIG. 11 is still in place and maintaining the channel well. The three-branch fluidizer embodiment is installed just to the updrift side of jetty 201, arranged like an arrowhead and terminating near the seaward end of the jetty, which supports exhaust riser 226 just as before, from which transport line 224 extends to downdrift beach 215. Again, the centerfeed of the piping assembly is omitted here, as are the earth anchors or other securing means, to simplify the relatively small-scale view.

Figure 14:
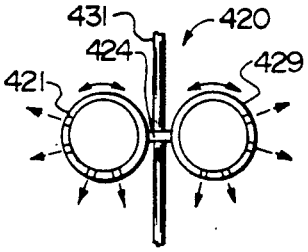
FIG. 14 has an alternative fluidization dual-pipe embodiment.

FIG. 14 shows alternative "barbell" embodiment 420 of dual-pipe assembly according to this invention. An intermediate portion of downward pulling earth anchor 431 is seen (bisecting the assembly). In this embodiment two side-by-side pipes 421 and 429 joined by bracket 424, to which the anchor fastens, are arranged so that during fluidizing for emplacement their openings jet fluid mainly downward (solid arrows). Once the pipes are in place, usually partially buried, the openings are reoriented to jet fluid mainly laterally outward and apart (broken arrows). This is done by rotating the pipes (or close-fitting foraminous sleeves—external or internal—not shown) about their longitudinal axis, so that during use, whether for stabilization or fluidization, their active openings will be oriented for best effect, as in the previously described working pipes of this invention. Such convertibility is possible also with over-and-under dual piping but is usually more important with side-by-side embodiments according to this invention.

FIGS. 15 to 20 show alternative embodiments of apparatus useful in burying piping for use in subsoil fluidization or stabilization.

Figure 15:
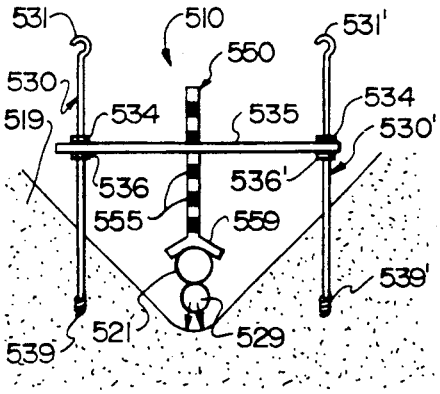
FIG. 15 is a schematized end elevation of foraminous piping flanked by a pair of pull-down earth anchors useful in emplacing it.

FIG. 15 shows, in schematized end elevation, embodiment 510 of foraminous piping flanked by pull-down means used to emplace it. Pair of earth anchors 530, 530' are bridged by tie bar 535, whose ends are retained detachably to the respective anchors between upper and lower nutlike collars 534, 534' and whose center is held by vertical pushrod 550—here indicated by an adjacent arrow as moving downward. The pushrod has alternate light and dark segments along its length, the latter corresponding to spaces between protrusions. Inverted V-shaped bottom end 559 of the pushrod straddles upper pipe 521 overlying attached fluidizing lower pipe 529 (with arrows).

Figure 16:
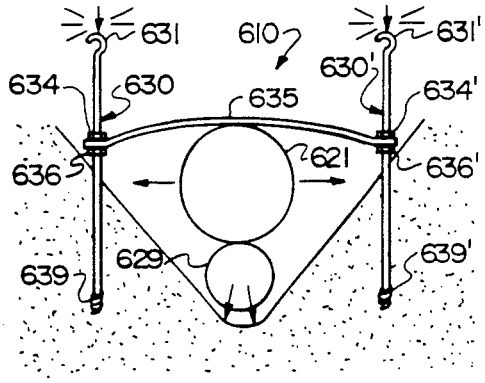
FIG. 16 is a schematized end elevation of piping emplaced by earth anchor "staples" straddling it and boring into the subsoil.

FIG. 16 shows somewhat similarly to FIG. 15 embodiment 610 but without any pushrod. Here tie bar 635 is bowed downward at the ends by flanking pair of earth anchors 630, 630'—which have been driven staple-like into the subsoil by such means (not shown) as manually wielded sledge hammers or preferably a pile driver with a suitably shaped lower end to receive the "staples" while avoiding the piping.

Figure 17:
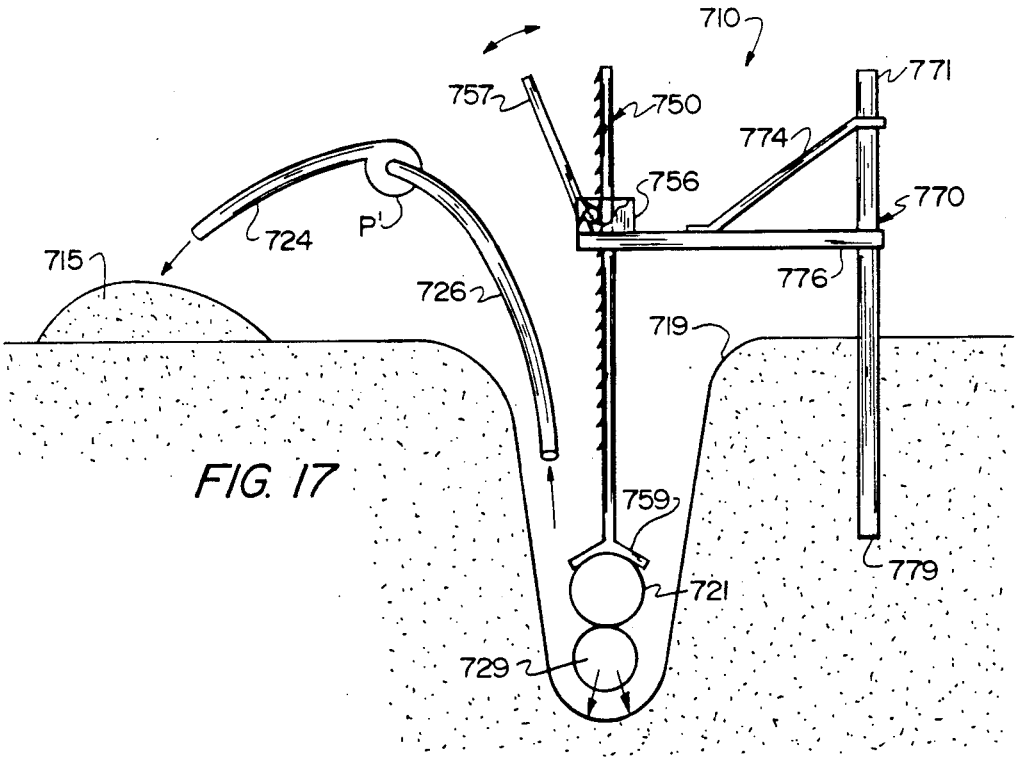
FIG. 17 is a schematized end elevation of such piping being emplaced by jacking device located alongside but spaced from the piping.

FIG. 17 shows embodiment 710 in which piping pair 721, 729 is being emplaced with the aid of pushrod 750 with inverted V-shaped bottom end 759 straddling the upper pipe. This pushrod is in rack form with teeth 755 along one side, fitting into ratchet means 756 with actuating handle 757 extending from it arcuate double arrow). The ratchet means is mounted on the end of horizontal arm 776 of jackpost 770 which has brace 774 from the arm to top end 771 of the post, whose bottom end 779 is buried in subsoil 719. Pump P' has intake line 726 (with arrow) extending alongside the pushrod into the excavation and has outlet line 724 discharging removed sand onto heap 715, as onto a beach needing replenishment.

Figure 18:
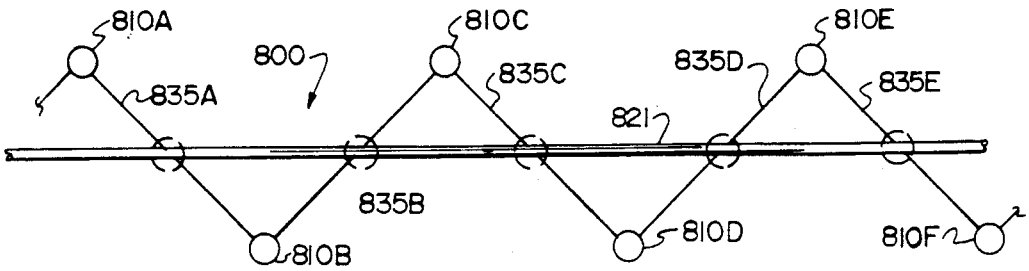
FIG. 18 is a plan view of a zigzag arrangement of means emplacing or holding piping along the longitudinal axis of the zigzagging.

FIG. 18 shows schematically arrangement 800 of individual sites 810*a* to 810*f* of anchoring means for piping 821 with intervening zigzag tie down means 835*a* to 835*e*, shown with broken circles overlying the piping as allowance for associated pushrod or equivalent means.

Figure 19:
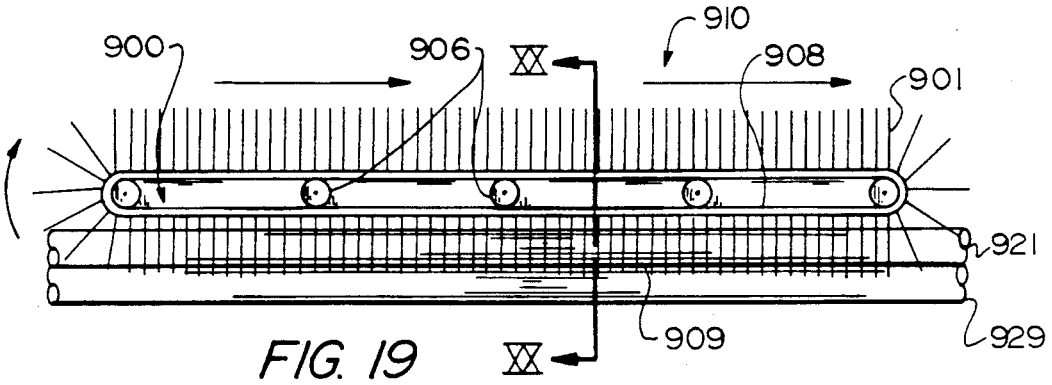
FIG. 19 is a schematized side elevation of mechanism for raking out objects from the desired rest position of foraminous piping.
Figure 20:
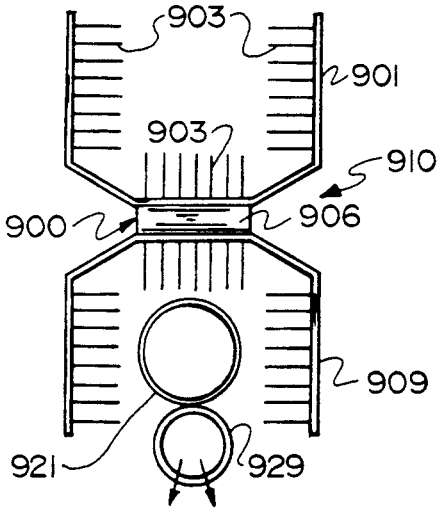
FIG. 20 is a side elevation of the mechanism of FIG. 19.

FIGS. 19 and 20 show schematically, in respective side and end elevations, embodiment 910 of upper and lower piping 921, 929 surmounted by rake means 900. Transverse rollers 906, spaced above and along a horizontal length segment of the piping, support an endless rake belt 908 of upper and lower flights 901 and 909. The belt carries U-shaped tines, upright in the upper flight and inverted in the lower flight, each with inwardly extending vertical and horizontal bristles 903 spaced from each other. Supporting and driving means for this rake means are omitted but can be readily visualized.

Practicing this invention in its various aspects is readily understood in the light of the foregoing description and illustration. It will be understood that for convenience in installation and possible removal the piping is conveniently provided in modules of about a hundred meters (or submultiples thereof), with provision for ready attachment and detachment. Materials and accessories are considered following the description of the various illustrations and operational commentary. It will also be understood that variations in the identified embodiments often may be interchanged in part to produce additional modifications or embodiments.

As is apparent from the sequence of FIGS. 1 to 6, dual piping of this invention may be laid out, preferably above mean high water, parallel to the shoreline. Locations for earth anchors are surveyed and marked, as with stakes, optionally with buoys tied thereto, preferably at a location a few feet under the mean low water level.

The earth anchors are positioned along a zigzag line (or two parallel lines) substantially parallel to the shoreline and are given a couple turns to secure them in the seafloor. Then ropes are passed over and under the piping and both ends are carried to the sea anchors, where one end of each is tied to the top loop of one of the seaward line of anchors, and the free end is passed through the top loop of a nearby landward anchor and is carried back up and over the piping, whereupon a pull on the free ends of the ropes will slide the piping down the beach and into the water and up against the sandward row of anchors. The end of each rope is then removed from the seaward anchor to which it was tied and is tied to the landward anchor, which is unscrewed and is then pulled onto shore. Alternatively it may be toted into place manually be or carried by floats and simply steered into place and dropped overside.

Air, water, or a combination of such fluids is pumped to the installation pipe, either in a steady stream or pulsating, as may be desired where the generally non-cohesive soil is appreciably lumpy. Fluid from the downward directed openings in the installation pipe stirs up the subsoil (usually sandy) and it becomes fluidized by the adjacent water, whether the fluid is air or water. Loosening of the subsoil enables the piping assembly to sink, and it is pulled downward by manually or mechanically rotating the earth anchors about their vertical axis so as to screw them downward into the seafloor. If desired, fluidized subsoil is exhausted from the vicinity by a vacuum hose and is deposited elsewhere. Once the installation pipe has reached the desired level, preferably a meter or more below mean low water, and is buried to the desired extent, fluid ejection from it is discontinued. The piping assembly can be covered to greater depth with subsoil, if desired, as by scraping it from a nearby location further offshore.

At such depth, water will drain into the working pipe, and can be removed therefrom by pumping out from the riser attached thereto. As there usually is an approximate balance between transport of subsoil toward and away from the beach by the onrush and the retreat of waves, removal of some of the water from underneath via the working pipe readily tips the balance toward deposit of a bit more sand than is carried back. Gradually, over weeks and months, the shoreline rises and builds seaward, thereby stabilizing the beach.

Buildup of beach and eventually dry land over the stabilization piping suggests that the piping be removed and be moved seaward or be installed elsewhere. Removal is accomplished similarly to installation, by fluidizing the subsoil in which the piping is buried. Both the installation pipe and the working pipe may be provided with fluid so as to loosen and fluidize the overlying soil, which may or may not pinpoint the piping sufficiently to aid its ready removal. If not, the tops of the earth anchors may be locatable, as by buoy, magnetic detection, or simply becoming visible from above. Once found, the earth anchors can be unscrewed, and with sufficient fluidization and lifting the piping can be freed and either be provided with floats or be taken on board a vessel to be transported to a new location.

At a fluidization location, such as to maintain a navigation inlet, the dual piping of this invention is emplaced in like manner as for beach stabilization. Then, however, after the fluidizing flow to the installation pipe is terminated, fluid is supplied to the working pipe for ejection into the surrounding subsoil to fluidize it for removal. If prevailing water currents fail to convey the fluidized material to a desired location, an exhaust line may help. Moreover, instead of piping fluidized material to a remote pump, a slurry pump can be located nearby to remove the sand or similar non-cohesive subsoil to a desired location on a barge or at the far end of a transport line. In this manner the fluidization not only enables navigation channels to be opened and be maintained, but removed sand can be deposited wherever a beach needs it.

The practice of this invention in its various aspects does not require any unusual materials, although readily available materials may be customized for use according to the invention. Dual piping, if not already available for whatever purpose, can be made up of two pipes welded, banded, or otherwise fastened together. Whether integral or fastened together and separable, the over-and-under and the side-by-side pipe embodiments differ chiefly in their relative sizes (preferably unlike in the former and alike in the latter) and in as-installed orientation of their openings for fluid passage between their interior and the exterior: underneath for installation, and otherwise—preferably lateral—for fluidization (both sides for an overhead working pipe and one side only for side-by-side pipes). In stabilization usage, where flow may be relatively slow, pipes may tend to clog unless back-flushed, preferably in a pulsating manner. To preclude clogging by animal, plant, or mineral agents, pipes used for stabilization may be provided with close-fitting, preferably removable mesh, or otherwise porous, jackets—as common in underground irrigation systems for a like purpose.

The pipes may be made of metal to assist their burial or may be made of plastic to aid their handling and removal, also to preclude clogging from electrolytic action. The flow openings in the pipes may be produced by drilling or piercing, or they may be provided during manufacture of the pipes, as by molding or otherwise. They may be provided with suitably directional resilient flapper valves. Pipes formed by rolling may be provided when flat with a notched or slotted edge or with spacers, to form openings when partially overlapped by edges, as in Chapin's U.S. patents (e.g., U.S. Pat. No. 4,642,152).

In fluidization of non-cohesive subsoils or like materials, the fluid of choice is usually water, as it is here most of the time, but sometimes air or a mixture of air and water may be preferable, as when piping being emplaced encounters clayey, pebbly, or obstacle conditions that can better be fragmented by exposure to pulsating flow—which may also be provided by variable-flow water pumping. As experience is gained, operators learn what fluid is preferable for removal of various obstacles. The rake mechanism of this invention will cope with most debris that may be encountered in the subsoil. Of course, a buried rubber tire or a railroad tie may require more drastic steps. However, as movement of sandy soils tends to stratify less dense objects upward and denser ones downward, lighter objects usually are found on or near the surface, where they are readily removable, and heavier ones are buried deeper than the purposes of this invention lead one to go.

In fluidization for channel maintenance, the installation pipe may be made readily detachable from the working pipe in the over-and-under embodiment and be detached for further installation use in the interest of economy once the assembly has been emplaced.

Earth anchors are conventional, usually made of steel, and may be obtained in a variety of sizes. Collars or other attachments are easily welded to the anchors. Tie bars and pushrods are readily available, in steel or other desired material. Jacking mechanism is also well known and can be built or purchased. The rake mechanism is custom-made but can be duplicated easily from the description and illustration in this specification.

Preferred embodiments and variants are suggested above for this invention. Other modifications may be made, as by adding, combining, deleting, or subdividing compositions, parts, or steps, while retaining all or some of the advantages and benefits of the present invention—which itself is defined in the following claims.

The claimed invention:

1. In placement of foraminous piping along a desired route in subsoil adapted to become non-cohesive when fluidized, the steps of jetting a fluid medium from the foraminous piping downward onto and into such subsoil to fluidize it in the vicinity thereof, flanking the piping with pairs of earth anchors, in the subsoil spaced apart beyond the fluidization vicinity, and through interconnection therewith, pressing the foraminous piping downward from above by the earth anchors into the fluidized subsoil until it is below the level of adjacent subsoil located apart from the fluidization vicinity.

2. Piping placement according to claim 1, including the step of pumping fluidized subsoil away from the fluidization vicinity.

3. Piping placement according to claim 1, including the step of interconnecting pairs of flanking earth anchors with tie bars passing directly over and resting on top of the flanked piping, and pressing the pairs of earth anchors downward from above, and thereby pressing the tie bars and the underlying piping downward.

4. Piping placement according to claim 1, including the step of interconnecting pairs of flanking earth anchors with tie bars passing directly over the flanked piping, and at each such location, inserting upright push rods between and contiguous with both the piping and the overhead tie bars, and screwing the earth anchors into the subsoil and thereby pressing the tie bars and the underlying piping downward.

5. In placement of foraminous piping along a desired route in subsoil adapted to become non-cohesive when fluidized, the steps of jetting a fluid medium from the foraminous piping downward onto and into such subsoil to fluidize it in the vicinity thereof, placing in the subsoil alongside the piping, spaced apart from the fluidization vicinity, a jackpost having a braced member extending over the piping and provided there with push-rod lowering means, inserting a upright push rod between and contiguous with both the piping and the overhead push-rod lowering means, and actuating the push-rod lowering means and thereby pressing the underlying piping downward.

6. Piping placement according to claim 5, wherein the push-rod lowering means comprises manually actuatable ratchet mechanism.

7. A piping assembly including a pair of foraminous fluidization pipes secured together and parallel, in combination with apparatus for emplacing the piping assembly along a route in subsoil adapted to become non-cohesive when fluidized, including pairs of earth anchors means, arranged in a zigzag pattern substantially coaxial with the piping assembly as viewed in plan, and flanking the piping in and beyond fluidization vicinity, interconnected above the piping and also adapted to be lowered into the subsoil at their respective locations and acting to force the piping downward.

8. Piping assembly in combination with apparatus according to claim 7, including tie rods interconnecting adjacent earth anchors in the zigzag pattern and passing across the piping assembly and including means to press downward onto the piping assembly to aid its emplacement.

9. Method of placing foraminous piping in fluidizable subsoil along a desired route, comprising the steps of laying along the route the foraminous piping to be emplaced, putting a plurality of depth-adjustable anchoring means in the subsoil alongside and flanking the route, then interconnecting each anchoring means to at least one such anchoring means on the opposite side of the route, such interconnecting means being above, and adapted as their depth is increased to press down on the piping laid along the route, and fluidizing the subsoil below the piping by jetting water from the foraminous piping into the underlying subsoil to fluidize it.

10. Method according to claim 9, including the step of zigzagging such interconnection back and forth across the piping route.

11. Method according to claim 9, including the subsequent step of pressing the piping into the fluidized subsoil by lowering the anchoring means into the flanking subsoil by so adjusting it.

12. Method according to claim 9, including the subsequent step of removing the anchoring means.

13. Piping emplacement apparatus for emplacing foraminous piping along a route in underlying subsoil adapted to become non-cohesive when wet, comprising a plurality of depth-adjustable anchoring means inserted into the subsoil alongside and flanking the route, relatively rigid means adapted to interconnect each anchoring means to at least one such anchoring means on the opposite side of the route across and above such piping laid along the route, and adapted, with such anchoring means adjusted to increased depth to press the piping down into the underlying non-cohesive subsoil.

14. Piping emplacement apparatus according to claim 13, wherein such interconnecting means connects each such anchoring means to two such anchoring means on the opposite side of the route.

15. Piping emplacement apparatus according to claim 13, wherein the interconnecting means has a zigzag configuration in plan.

16. Piping emplacement apparatus for emplacing foraminous piping along a route in underlying subsoil adapted to become non-cohesive when wet, comprising a plurality of depth-adjustable anchoring means inserted into the subsoil alongside and flanking the route, a removable tie bar means interconnecting each anchoring means to at least one such anchoring means on the opposite side of the route and overlying the piping when in place along the route, and vertical push rod means adapted to be interposed removably between such overlying tie bar means and the underlying piping so as to force the piping downwardly into the subsoil when such subsoil has been rendered non-cohesive.

17. Piping emplacement apparatus according to claim 16, wherein the push rod has an inverted V-shaped lower end structure.

18. Piping emplacement apparatus according to claim 16, wherein the push rod has notches along its length adapted to engage the tie bar means removably at diverse distances from its lower end.

* * * * *